US008157607B2

(12) United States Patent
Cowles et al.

(10) Patent No.: US 8,157,607 B2
(45) Date of Patent: Apr. 17, 2012

(54) THROWING DISC

(76) Inventors: William Cowles, Brooklyn, NY (US); William DiMotta, East Norwich, NY (US)

( * ) Notice: Subject to any disclaimer, the term of this patent is extended or adjusted under 35 U.S.C. 154(b) by 636 days.

(21) Appl. No.: 11/992,266

(22) PCT Filed: Sep. 22, 2006

(86) PCT No.: PCT/US2006/037286

§ 371 (c)(1),
(2), (4) Date: May 18, 2009

(87) PCT Pub. No.: WO2007/038449

PCT Pub. Date: Apr. 5, 2007

(65) Prior Publication Data

US 2009/0247041 A1 Oct. 1, 2009

Related U.S. Application Data

(60) Provisional application No. 60/719,514, filed on Sep. 23, 2005.

(51) Int. Cl.
*A63H 27/00* (2006.01)

(52) U.S. Cl. ..... 446/48

(58) Field of Classification Search ..... 446/46, 446/47, 48

See application file for complete search history.

(56) References Cited

U.S. PATENT DOCUMENTS

| | | | | |
|---|---|---|---|---|
| 4,104,822 | A | 8/1978 | Rodgers | 46/74 D |
| 4,307,535 | A | 12/1981 | Martin | 46/74 D |
| 4,560,358 | A | 12/1985 | Adler | 446/46 |
| 4,944,707 | A | 7/1990 | Silverglate | 446/48 |
| 5,131,879 | A | 7/1992 | Bouchakian | 446/48 |
| 5,800,237 | A | 9/1998 | Cummings | 446/48 |
| 2003/0068954 | A1 * | 4/2003 | Oblack | 446/34 |
| 2004/0005837 | A1 | 1/2004 | Wang | 446/46 |

FOREIGN PATENT DOCUMENTS

| | | |
|---|---|---|
| EP | 1310162 | 5/2003 |
| WO | WO98/09698 | 3/1998 |
| WO | WO03/086552 | 10/2003 |

OTHER PUBLICATIONS

International Search Report (in English) dated Mar. 8, 2007, International Preliminary Report on Patentability (Chapter I of the Patent Cooperation Treaty), in English, dated Mar. 26, 2008 and Supplementary European Search Report, in English, dated Oct. 15, 2010.

* cited by examiner

*Primary Examiner* — John Ricci
(74) *Attorney, Agent, or Firm* — Gerald T. Bodner

(57) ABSTRACT

A throwing disc includes an elliptical, continuous, flexible frame which changes shape during flight. The flexible frame defines a central opening through the thickness thereof. The flexible frame has an arched shape with a height that changes during flight and which defines a three dimensional cavity situated at the bottom side of the frame to provide lift to the throwing disc during flight.

23 Claims, 7 Drawing Sheets

THROWING DISC

CROSS REFERENCE TO RELATED APPLICATION

This application is related to U.S. Provisional Application Ser. No. 60/719,514 filed on Sep. 23, 2005, and entitled "Elliptical Throwing Ring", the disclosure of which is incorporated herein by reference and on which priority is hereby claimed.

BACKGROUND OF THE INVENTION

1. Field of the Invention

The present invention relates to throwing discs for recreational use.

2. Description of the Prior Art

Throwing discs are used for throwing and catching entertainment between two or more people. Two popular and well known throwing discs are commonly referred to by the trademarks Frisbee™ and Aerobie™. The Frisbee™ throwing disc is a circular disc in which the design characteristics occur in a single plane, that is, it exhibits a two dimensional shape that revolves about a central axis. Numerous geometric variations (i.e., leading edge, airfoil, rim, material, size and weight) for circular flying discs, such as the Frisbee™ throwing disc, are well known and patented. There are also "throwing rings" that are similar in nature to the solid or full-surface circular throwing disc, such as the Frisbee™ disc referred to previously, because they, too, are circular and designed with two dimensional planar profiles revolved about a central axis.

The Aerobie™ flying ring is disclosed in U.S. Pat. No. 4,560,358 and a variation thereof is disclosed in U.S. patent application Ser. No. 10/191,369, filed on Jul. 4, 2002, having Publication No. US20040005837 A1. Both documents illustrate, in FIG. 2C of the former patent and FIG. 8C of the latter published patent application, a throwing ring with an elliptical shape. The elliptical shape in the aforementioned published application is described to have the characteristics of a boomerang or self-returning device. The throwing ring described in the earlier U.S. patent is said to be capable of flying 200 meters straight. The Aerobie™ throwing ring appears to be successful with regard to airfoil design, weight and surface area, but it is still a revolved profile refined from ancient Chakram designs originating from the Greek, Romans and Sikhs thousands of years old. The elliptical design variations appear to not have been based on the required research to solve the very different aerodynamic geometries required of an elliptical throwing ring to have optimized flight characteristics, especially lacking engineering in the gyroscopic and metamorphic principles.

OBJECTS AND SUMMARY OF THE INVENTION

It is an object of the present invention to provide a throwing disc for recreational purposes having a generally oblong or elliptical flexible frame.

It is another object of the present invention to provide an elliptical throwing disc which achieves significant reduction in weight and maximizes the quality of flight.

It is a further object of the present invention to provide a non-round throwing disc which has a thinner and/or flatter profile than the well known and popular Frisbee™ and Aerobie™ throwing discs.

It is yet a further object of the present invention to define a throwing disc which is easier to hold and throw with improved accuracy than conventional throwing discs.

It is still a further object of the present invention to provide an elliptical throwing disc which has better aerodynamic characteristics suited for throwing and catching sport than well known and popular throwing discs.

It is still another object of the present invention to provide an elliptical throwing disc which is less heavy and uses less wrist snap to impart necessary rotational forces to overcome weight parameters for flight than the popular Frisbee™ and Aerobie™ throwing discs.

A throwing disc constructed in accordance with one form of the present invention includes a non-round, continuous, flexible frame which changes shape during flight. The flexible frame defines a central opening through the thickness thereof. The flexible frame has a top side, a bottom side opposite the top side, an outer peripheral edge and an inner peripheral edge situated radially inwardly of the outer peripheral edge. The flexible frame has an arched shape with a height at its apex that changes during flight. The arched shape flexible frame defines a three dimensional cavity situated at the bottom side of the frame to provide lift to the throwing disc during flight. Preferably, the flexible frame is elliptical in shape.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
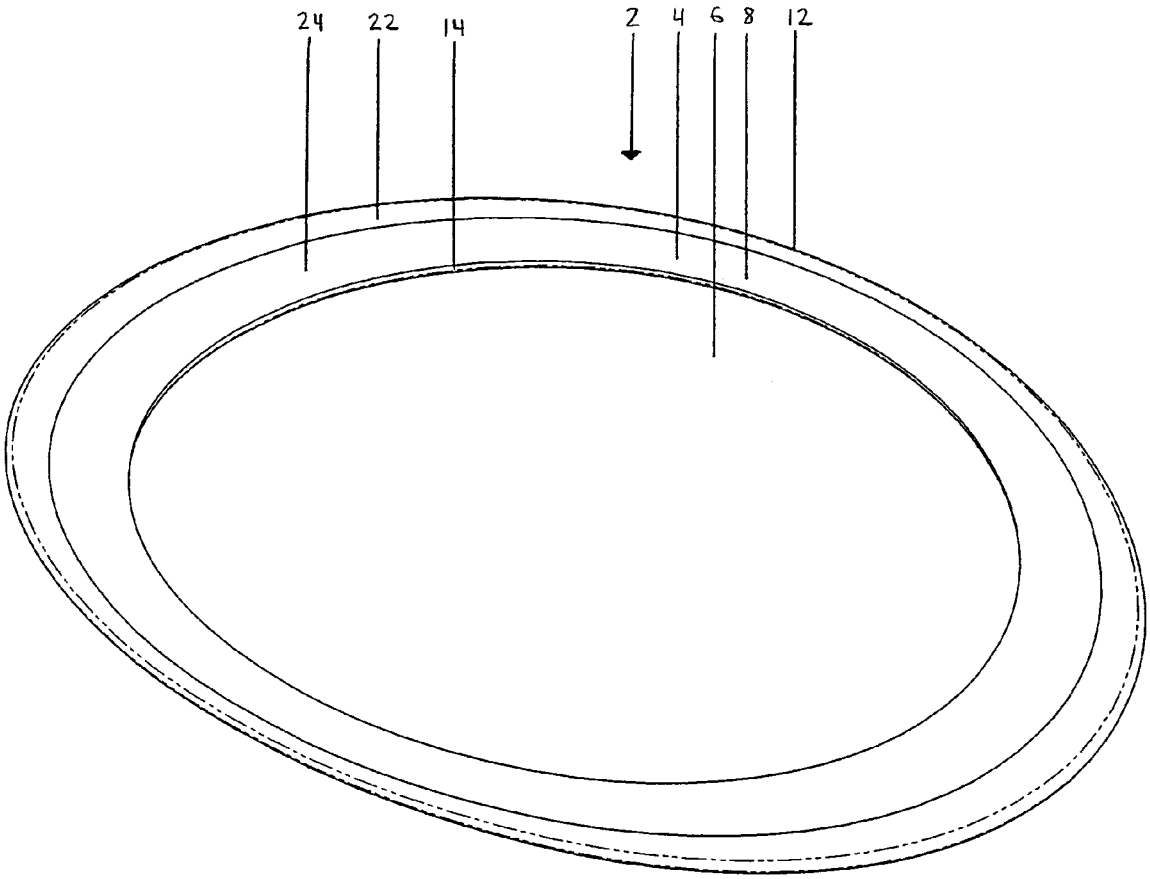
FIG. 1 is an isometric view of a throwing disc constructed in accordance with one form of the present invention.
Figure 2:
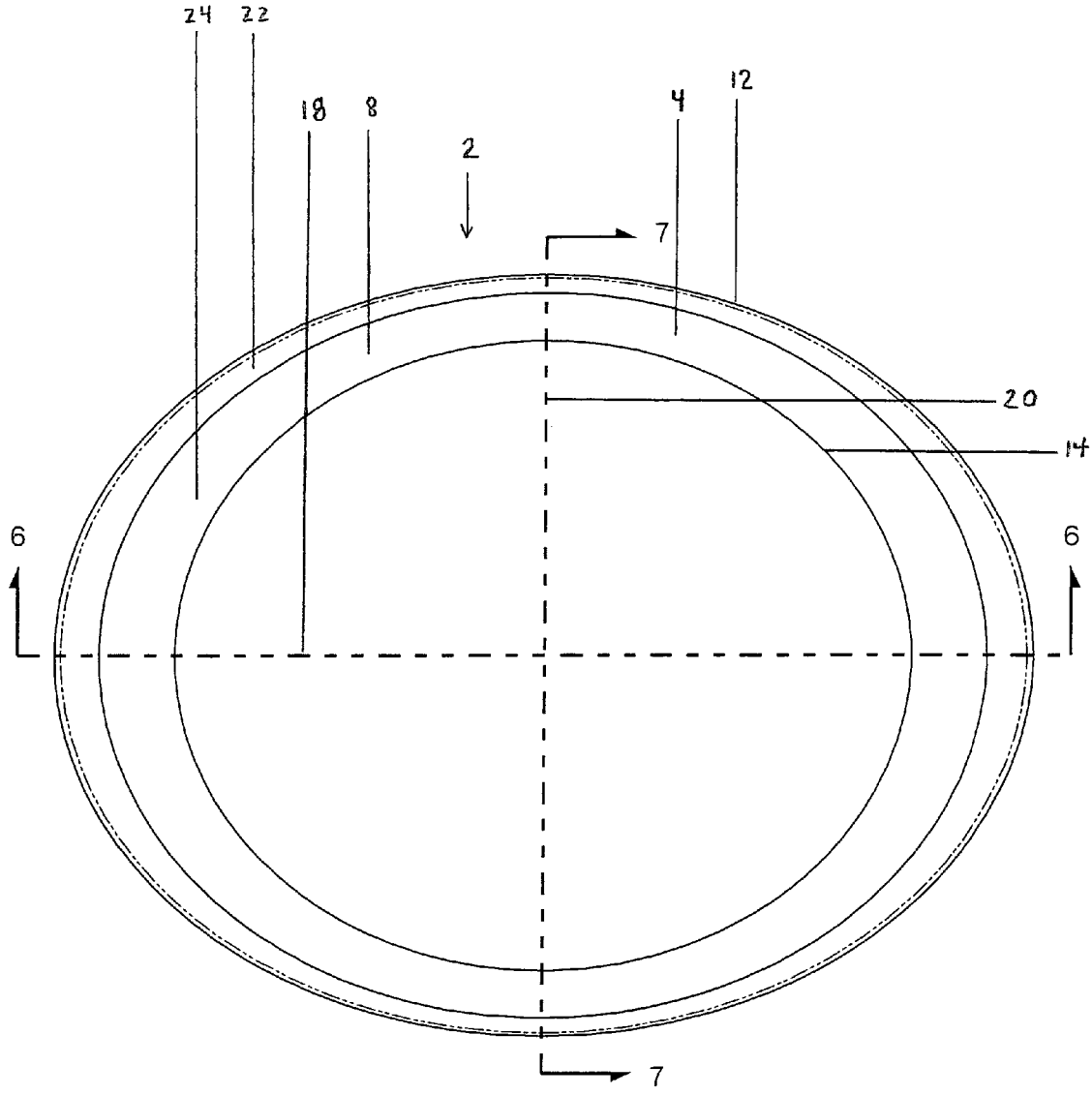
FIG. 2 is a top plan view of the throwing disc of the present invention shown in FIG. 1 of the drawings.
Figure 3:
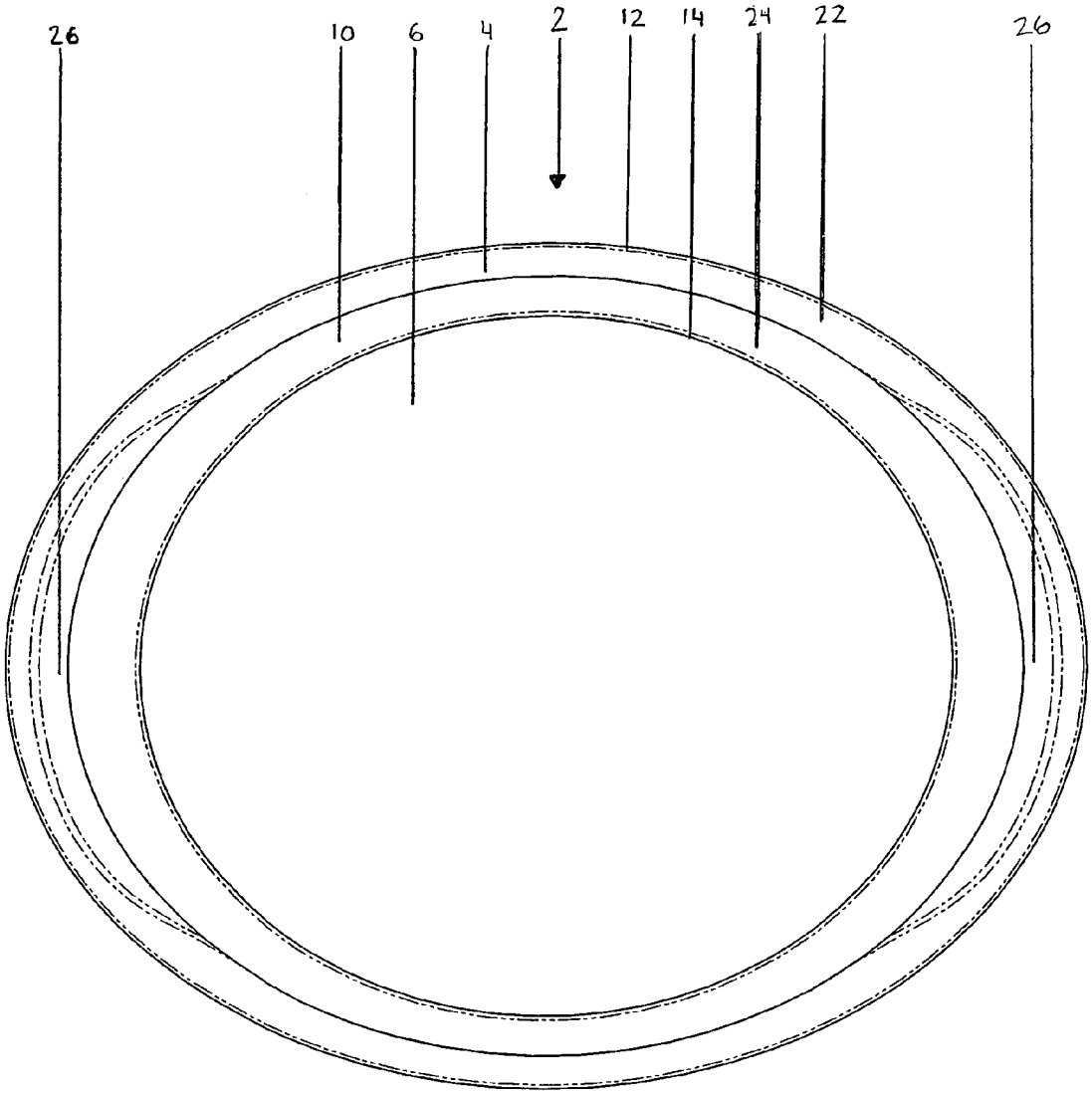
FIG. 3 is a bottom view of the throwing disc of the present invention shown in FIGS. 1 and 2 of the drawings.
Figure 4:
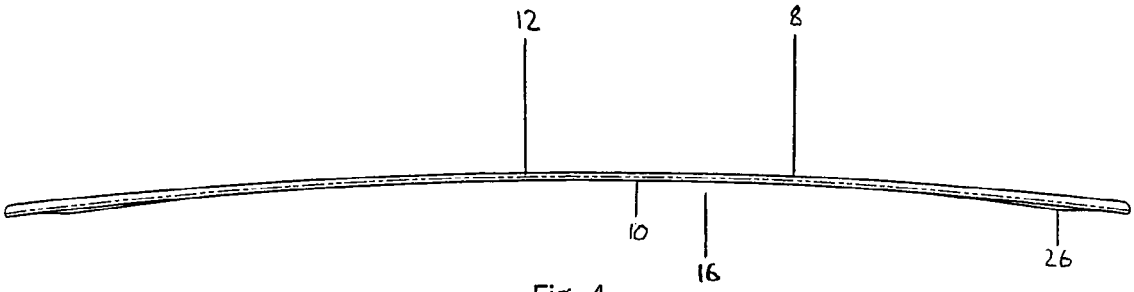
FIG. 4 is a side view of the throwing disc of the present invention shown in FIGS. 1-3.
Figure 5:
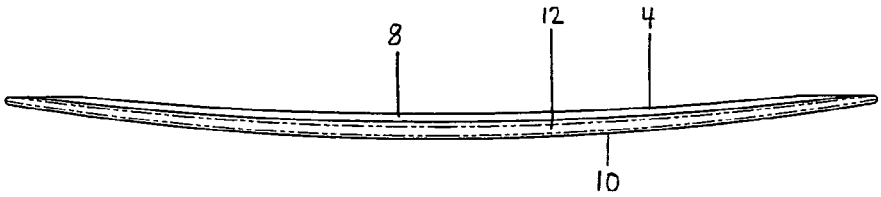
FIG. 5 is a front view of the throwing disc of the present invention shown in FIGS. 1-4.

Referring initially to FIGS. 1-9 of the drawings, it will be seen that a throwing disc 2 constructed in one form of the present invention includes a non-round, continuous, flexible frame 4 which changes shape during flight. The flexible frame 4 defines a central opening 6 through the thickness thereof. The flexible frame 4 has a top side 8, a bottom side 10 opposite the top side, an outer peripheral edge 12 and an inner peripheral edge 14 situated radially inwardly of the outer peripheral edge 12. The flexible frame has an arched shape with a height that changes during flight. The arched shaped flexible frame 4 defines a three dimensional cavity 16 situated at the bottom side thereof to provide lift to the throwing disc 2 during flight.

In a preferred form of the invention, the flexible frame 4 of the throwing disc is generally oblong in shape, and includes a major axis 18 and a minor axis 20 situated perpendicularly to the major axis 18. Preferably, the flexible frame 4 is symmetrical about the major axis 18 and the minor axis 20. Even more preferably, the flexible frame 4 is elliptical in shape. The central opening 6 defined by the flexible frame 4 is preferably generally oblong in shape, and more preferably is elliptical in shape.

A number of particular structural features of the throwing disc 2 of the present invention provide the disc 2 with improved aerodynamic capabilities over conventional throwing discs. First, the width of the flexible frame 4 between the outer peripheral edge 12 and the inner peripheral edge 14 measured at the major axis 18 is preferably greater than the width of the frame 4 between the outer peripheral edge 12 and the inner peripheral edge 14 measured at the minor axis 20. Second, the average thickness of the frame 4 between the top side 8 and the bottom side 10 measured at the major axis 18 is preferably greater than the average thickness of the frame 4 between the top side 8 and the bottom side 10 measured at the minor axis 20. Third, the incremental weight of the frame 4 measured at the major axis 18 over an incremental arcuate extent of the frame 4 is preferably greater than the incremental weight of the frame 4 measured at the minor axis 20 over the same incremental arcuate extent of the frame 4.

Preferably, the flexible frame 4 includes an outer ring 22 and an inner ring 24 joined to the outer ring 22 and situated radially inwardly of the outer ring 22. Even more preferably, the inner ring 24 is formed from a first material and the outer ring 22 is formed from a second material, the second material being preferably more flexible than the first material. In another preferred form of the throwing disc 2 of the present invention, the outer ring 22 is formed from molded rubber or from a thermoplastic elastomeric material, and the inner ring 24 is formed from polycarbonate. The flexible frame 4 may be formed from injection molded plastic.

Figure 9:
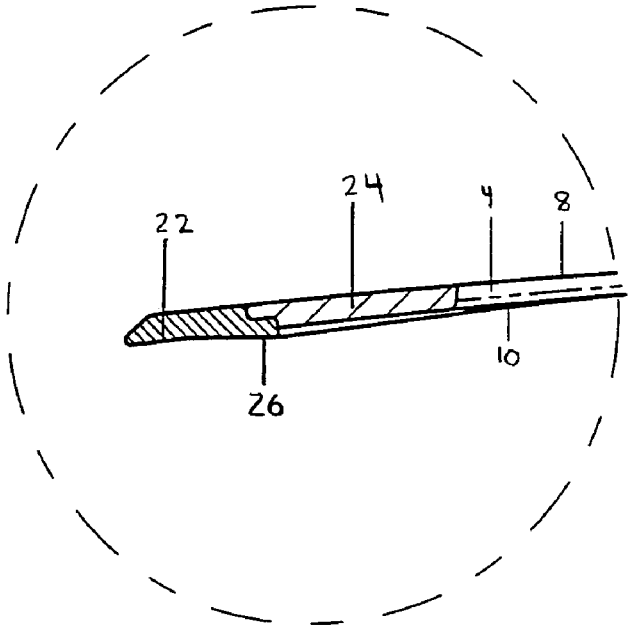
FIG. 9 is an enlarged cross-sectional view of a portion of the throwing disc of the present invention, illustrating a modification to the embodiments shown in FIGS. 1-7.

The outer peripheral edge 12 of the flexible frame 4 may further be sloped inwardly from the bottom side 10 to the top side 8 to divert air flow over the top side 8 of the flexible frame 4 during flight, as shown in FIG. 9 of the drawings.

A throwing disc 2 has been constructed which in its preferred dimensions exhibits optimal aerodynamic stability and capabilities. This preferred throwing disc 2 has the following characteristics. The width of the flexible frame 4 measured along the major axis 18 between diametrically opposite sides of the outer peripheral edge 12 is about 13.25 inches, and the width of the flexible frame 4 measured along the minor axis 20 between diametrically opposite sides of the outer peripheral edge 12 is about 10.25 inches. The height of the arched shape of the flexible frame 4 not during flight is about 0.41 inches, and the bottom side 10 of the flexible frame 4 is formed with a curvature between diametrically opposite sides of the outer peripheral edge 12 along the major axis 18 having a radius of about 53.3 inches. The thickness of the flexible frame 4 measured near the outer peripheral edge 12 preferably varies from about 0.090 inches along the portions of the frame in proximity to the minor axis 20 to about 0.135 inches along the portions of the frame in proximity to the major axis 18. Furthermore, the thickness of the frame 4 preferably increases from the inner peripheral edge 14 to near the outer peripheral edge 12 over portions thereof in proximity to the major axis 18. The weight of the throwing disc 2 is about 78.8 grams, plus or minus about 3 grams.

The unique performance characteristics of the throwing disc 2 of the present invention are defined by the disc geometry, material properties and the physics and/or dynamics during flight. The throwing disc 2 is symmetrically curved about the major 18 and minor axes 20. The disc 2, when thrown with forward spinning motion, revolves about its center of mass axis and deforms by means of centrifugal force coupled with the material properties and cross-sectional variation throughout the flexible frame 4. The effect is a combined lifting and/or bending of each of the more massive ends located at the portions of the flexible frame 4 situated in proximity to the major axis 18. As the disc 2 spins through the air with forward momentum, the disc becomes a dynamic airfoil with variable speed and lift properties.

The elastomer design of the outer ring portion 22 of the flexible frame preferably covers the entire outer peripheral edge 12 of the throwing disc 2 to aid in catching comfort as well as eliminating tooling complexity during production. Preferably, the outer peripheral edge 12 of the flexible frame 4 is particularly shaped to divert air flow over the top side 8 of the disc 2, and further eliminates sharp outer edges for more comfortable catches. Even more preferably, a raised portion 26 of the outer peripheral edge 12 of the flexible frame 4 extends outwardly from the bottom side 10 of the flexible frame 4 as an added gripping surface.

The flexible material for the frame 4 is preferably injection molded plastic. The throwing disc 2 preferably includes an inner ring 24 made of engineered polycarbonate chosen for its high durability. The outer ring 22 of the flexible frame 4 is preferably made of specially formulated thermoplastic elastomer, or TPE, and will be bonded to the inner ring 24 by means of compatible chemical composition and heat molding by "over-molding" or "two-shot" molding, for example. One of the main purposes of the TPE outer ring portion of the flexible frame 4 is to soften the impact force as the throwing disc 2 is caught or deflected by a player. The softness or TPE durometer of the outer ring 22 may be modified during production. Furthermore, the stiffness or elastic modulus of the outer ring 22 can be adjusted with different plastic materials, as would be well known to someone skilled in the art.

The throwing disc 2 may be scaled to a range of humanly compatible sizes. If scaled, the weight of the disc 2 will also preferably be scaled in proportion to the size of the disc 2 with considerations for the material's modulus of elasticity and spin rate.

It has been determined through testing and observation of materially and dimensionally accurate prototypes of the throwing disc 2 of the present invention that the disc 2 rotates at an average rate of 7.5 Hz, plus or minus 1.5 Hz, or 450 RPM. At this rate, each end of the disc 2 exhibits approximately 16.44 N, or 3.7 pounds, of force acting to deform the disc 2 from the center of mass and/or center of rotation. In a testing laboratory, it has been documented that the deformation of the disc 2 when it is fixtured at the neutral portions of the arch and spun at speeds of 50 RPM to 400 RPM about the center of mass, the disc 2 exhibits consistent deformation at every 50 RPM interval, i.e., flattening the disc 2 and decreasing the height of the airfoil 16. Increased disc speeds in mid-flight have been observed and have been attributed to primarily the reduction of drag as the disc 2 deforms to a more compact shape.

Due to the unpredictable nature of the forward velocity of the disc imparted by the user, variable lift properties and wind speeds, forward speed and distance is determined on a per throw basis. Average throw distances for the optimally shaped disc 2 of the present invention described previously have been documented to be between about 150 feet to about 250 feet. The additional range may be attributed to the dynamic nature of the disc 2. As the disc 2 deforms to a decreased drag state, speed increases, thereby affecting lift properties, as lift varies as the square of the speed.

The throwing disc 2 of the present invention is designed primarily for the throwing and catching entertainment between two or more people. The throwing disc 2 is an improvement over the round, solid Frisbee™-styled throwing discs by its significant reduction in weight and its enhanced quality of flight.

The structure of the elliptical throwing disc 2 of the present invention departs from the conventional throwing discs with radical shape modifications. Due to the almost infinite variations and possibilities of shapes to define an elliptical or oblong form (i.e., straight lines, splines, arcs or any combination of these), the particular structure of the elliptical throwing disc 2 of the present invention has been optimized by adjusting and fine tuning such parameters as sectional thickness, curvature along the major and minor axes 18,20 and shape of the outer and inner peripheral edges 12,14. Gyroscopic and metamorphic principles have been taken into account in the design of the present invention to optimize the flight characteristics of the throwing disc 2.

The throwing disc 2 of the present invention, as described previously, has a molded-in curved arched shape, as shown in the figures. Also, a change of thickness from the center of the throwing disc 2, where it is thinner, to those portions of the flexible frame 4 which reside in proximity to the major axis 18, where it is thicker, adds flexibility to the disc 2.

Figure 6:
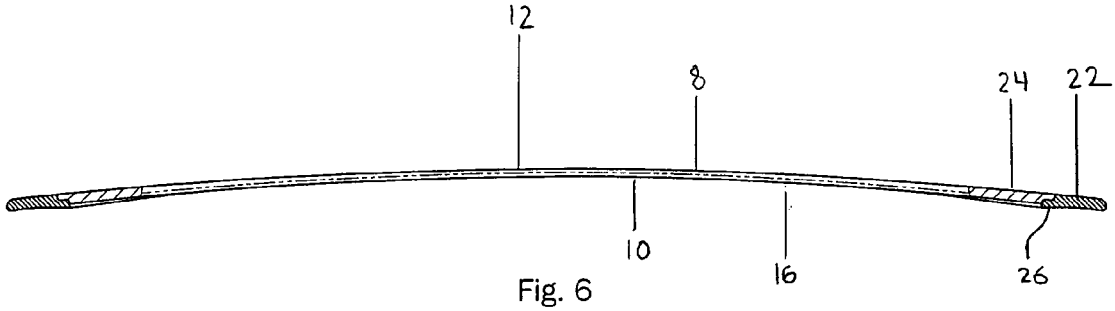
FIG. 6 is a cross-sectional view of the throwing disc of the present invention shown in FIGS. 1-5, taken along line 6-6 of FIG. 2.
Figure 7:
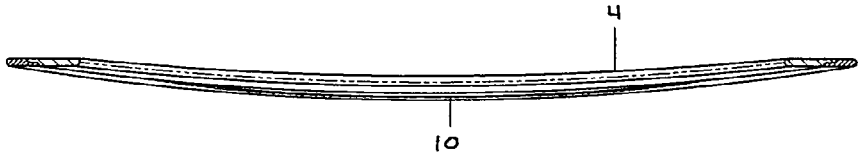
FIG. 7 is a cross-sectional view of the throwing disc of the present invention shown in FIGS. 1-6, taken along line 7-7 of FIG. 2.
Figure 8:
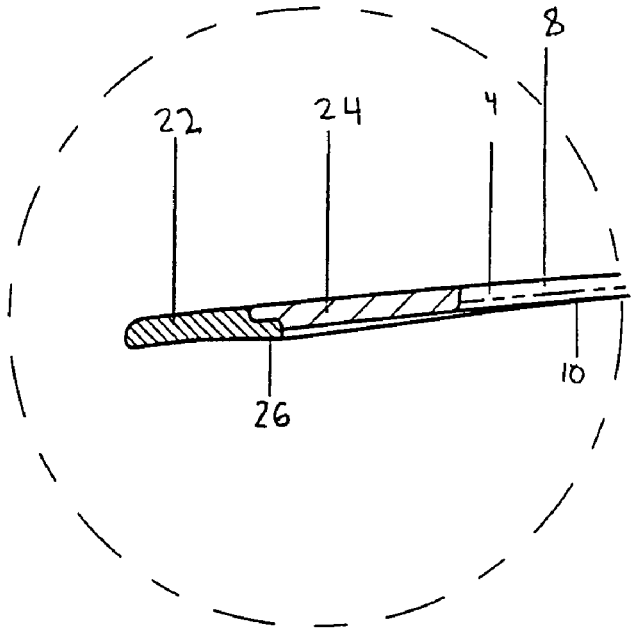
FIG. 8 is an enlarged cross-sectional view of a portion of the throwing disc of the present invention shown in FIGS. 1-7.

More specifically, when the disc 2 is illustrated in cross-section, as shown in FIGS. 6 and 7, it will be seen that it exhibits an arched shape that is defined by a straight line between diametrically opposite sides of the outer peripheral edge 12 and the apex of the curve which circumscribes the arch provided to the bottom side 10 of the disc 2. The arch gives the throwing disc 2 stability in flight based on airfoil lift principles. As the disc 2 leaves the hand of the thrower, the disc 2 spins freely about the center of its mass in the direction that velocity was imparted to it. The arch becomes a three dimensional cavity 16 defined by the spun bottom side 10 surface of the disc 2. In accordance with the Bernoulli effect, air velocity passing beneath this cavity 16 becomes slower, resulting in higher pressure, than air velocity passing over the top side 8 of the disc 2, resulting in lower pressure, giving lift to the disc 2 while in flight.

Another important aspect of the throwing disc 2 of the present invention is its ability to change its shape during flight using flexible molded materials and a thinner band of material along portions of the flexible frame 4 that are in proximity to the minor axis 20, tapering to thicker portions residing in proximity to the major axis 18. As the disc 2 spins, centrifugal forces reduce the height of the arch defined by the bottom side 10 of the disc 2 by stretching the disc 2 to a flatter shape. Towards the middle of flight, the flattened disc 2 decreases wind resistance as air passes faster over the disc 2, speeding the disc 2 and extending the flight. With the faster speed and smaller volumetric airfoil 16, a more stable flight is achieved. Towards the end of flight, as rotational forces and wind pressure overcome initial velocity and centrifugal forces, the disc 2 returns to its original shape, increases the volumetric airfoil 16, and stabilizes itself in slower flight with a floating effect. Furthermore, the diametrically opposed weighted, that is, heavier, portions of the flexible frame 4 in proximity to the major axis 18 of the disc 2 may compensate better for minute irregularities caused by the manufacturing process or molding, excessive use or other minor disc imperfections, as centrifugal forces causes a pulling away from the center of rotation with greater force than a conventional uniformly axial rotated disc or ring.

As mentioned previously, the disc 2 of the present invention is shaped similarly to an ellipse or other non-round shape that is preferably symmetric about the major axis 18 as well as the minor axis 20. Furthermore, the inner, central opening 6 defined by the continuous flexible frame 4 is preferably similarly shaped to be elliptical, and also symmetrically formed about the major axis 18 and the minor axis 20 of the throwing disc. As can be seen from the top view of the throwing disc 2 shown in FIG. 2 of the drawings, the flexible frame 4 is a continuous band of material having varying widths that increase from the inner peripheral edge 14 toward the outer peripheral edge 12. Furthermore, the width of the flexible frame 4 in proximity to the major axis 18 is greater than the width over portions thereof in proximity to the minor axis 20. The wider flexible frame 4 in proximity to the major axis 18 of the disc 2 offers ample grip for holding and stabilizing the disc 2 prior to throwing. Over-molded rubber along the majority of the disc perimeter will make catching the disc 2 safer and easier. The particular shape of the throwing disc 2 is also suitable for a whole hand grab of the outer peripheral edge 12 of the disc 2 as well as through the central opening 6.

As mentioned previously, the throwing disc 2 of the present invention may be scaled with regard to weight, surface area, arch height and other parameters, with minor adjustments in keeping with basic aerodynamic lift principles. With modifications to the material thickness and molded-in arch geometry, initial throwing speed and "float" properties may be adjusted. For optimum throwing and catching comfort, a combination of rigid yet flexible and semi-rigid (more flexible) materials are used for the outer ring 22 and inner ring 24 of the flexible frame 4 and are mechanically bonded to one another in the molding process by co-molding or over-molding. Special materials and injection molding processes (i.e., glass fiber, gas assist and durometer types) are envisioned to be used in order to further improve partial rigidity in the flexible frame 4 without compromising the ratio of surface area to weight.

The particular shape and structure of the throwing disc 2 of the present invention provide several advantages. For the thrower, less wrist movement is necessary to bring the disc 2 into flight, and is potentially easier on the wrist during longer play. Less effort in throwing may also mean a shorter learning curve for the beginner to the sport. To throw the disc 2 of the present invention, with the proper top orientation of the disc 2 in one hand, it is typical for the thrower to hold the disc with one or more fingers on the bottom side 10 and the thumb and base of the thumb on the top side 8. For a back hand throw, the arm and wrist of the thrower are slightly curled towards the thrower's body. The disc 2 that is held closer to the chest is now released when the elbow and wrist become extended to a straight arm position. The speed of the wrist and/or elbow extension transfers to the disc 2 and its velocity when the disc 2 is released at the point of full arm extension. Additional body movement of the thrower when choreographed with the basic arm release can aid in the distance the disc 2 of the present invention travels, like all other throwing discs and rings.

While learning the mechanics of throwing the disc 2 of the present invention, it was discovered that increased inertia is produced with minimal effort as the disc 2 is being swung about the fingertips (point of rotation) to the release point. The "moment arm" is greater than with a conventional Frisbee™ disc due to the "weighted" portions of the flexible frame 4 near the major axis 18 of the disc, and the elliptical shape of the disc 2. The elliptical throwing disc 2 of the present invention acts as an additional articulating segment of the thrower's arm at the point of release, and the natural extension of the arm provides for a more fluid throwing motion with added control. Also, with the elliptical disc's multiple grip positions, the thrower can fine tune the throwing mechanics to his or her preference.

The elliptical throwing disc 2 of the present invention is an improvement over the conventional Frisbee™ and Aerobie™ throwing discs in several respects. With a thinner and/or flatter profile, the elliptical throwing disc 2 of the present invention is easier to hold and throw with improved accuracy and better aerodynamic characteristics suited for this throwing and catching sport. Furthermore, adjustments to the size and the shape of the throwing disc 2 of the present invention can provide users with many disc types for various sporting activities. To the user, the elliptical disc 2 of the present invention performs better than a standard Frisbee™ throwing disc, as it is less heavy and requires less wrist snap to impart the necessary rotational forces to overcome the disc's weight parameters for flight. The throwing disc 2 of the present invention is also an improvement over the conventional Aerobie™ disc because of the observed controlled flight characteristics of the present invention at optimum short to mid range throwing distances of from about 50 feet to about 150 feet.

The throwing disc 2 of the present invention takes advantage of the mechanical phenomenon of a curved oblong disc naturally weighted on the two diametrically opposed ends of the major axis 18. The reduction of mass and use of overmolded TPE materials in the throwing disc 2 of the present invention achieve a lighter and more comfortable disc which can be mass-produced inexpensively. The throwing disc's inherent scalability and ability to be engineered with performance enhancing features greatly improve the throwing disc's marketability over many years.

Figure 10:
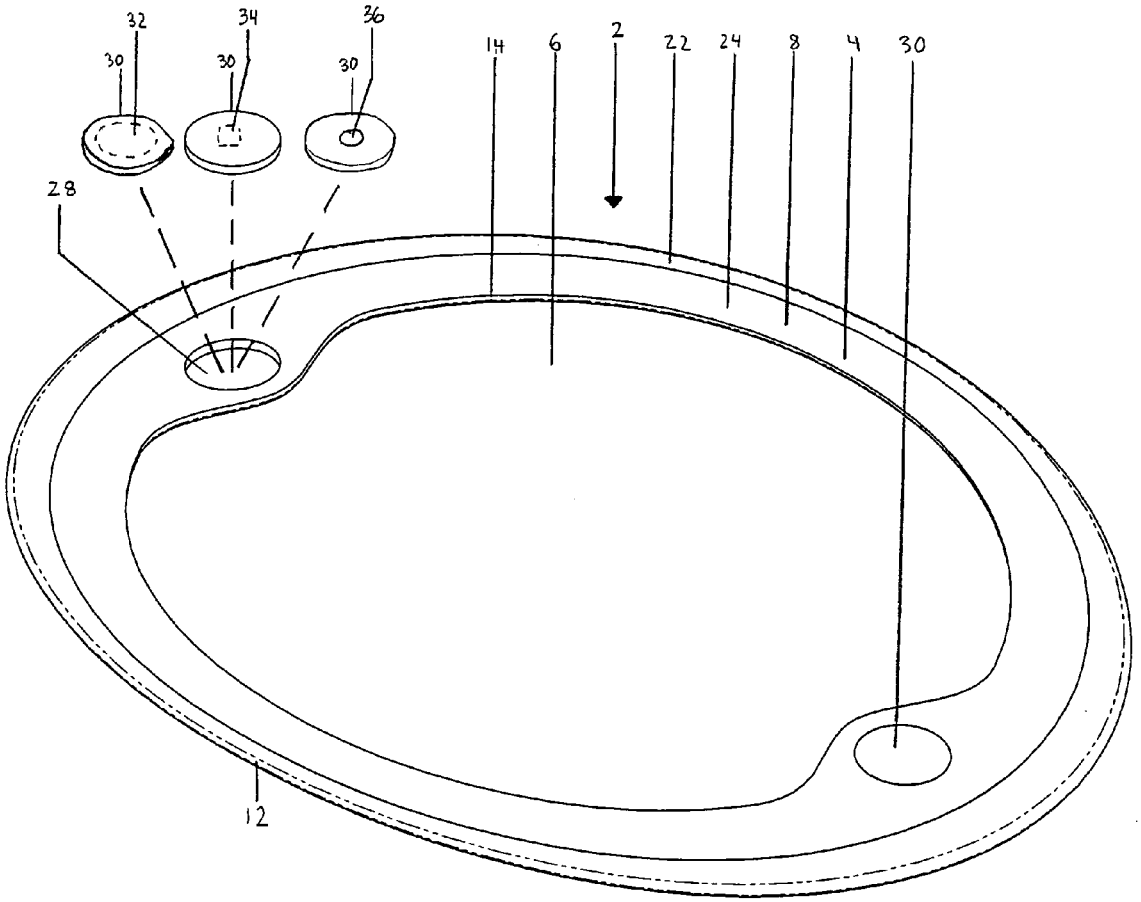
FIG. 10 is an exploded, top isometric view of a throwing disc constructed in accordance with another form of the present invention.

Another variation of the throwing disc 2 of the present invention is illustrated by FIG. 10 of the drawings. Here, it will be seen that one or more openings 28 are formed through the thickness of the flexible frame 4. The openings 28 are preferably situated diametrically opposite one another in proximity to the major axis 18 of the disc 2. The disc 2 further includes snap-in modules 30 that are receivable and held captive by the openings 28. Each snap-in module 30 may include a weight 32 interiorly thereof that will change the performance and play characteristics of the disc 2. Adding weighted snap-in modules 30 could affect the rotational speed, throw distances and possibly accuracy.

Another option is to include a radio frequency identification (RFID) tag 34 within the snap-in modules 30, in order to allow the disc 2 to be used with battery operated, electronic goal posts for ultimate and disc golf sports. Alternatively, the snap-in modules 30 may include exposed lighting devices, such as flashing light emitting diodes 36, or may be formed from phosphorescent materials, for nighttime play.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A throwing disc, which comprises:

a non-circular, continuous, flexible frame which changes shape during flight, the flexible frame defining a central opening through the thickness thereof, the flexible frame having a top side, a bottom side opposite the top side, an outer peripheral edge and an inner peripheral edge situated radially inwardly of the outer peripheral edge, the flexible frame having an arched shape both at rest and in flight, with a height that changes during flight, the arched shaped flexible frame defining a three dimensional cavity situated at the bottom side thereof to provide lift to the throwing disc during flight, wherein the flexible frame is generally oblong in shape, and includes a major axis and a minor axis situated perpendicularly to the major axis, the flexible frame being symmetrical about the major axis and the minor axis.

2. A throwing disc as defined by claim 1, wherein the flexible frame is elliptical in shape.

3. A throwing disc as defined by claim 1, wherein the width of the flexible frame between the outer peripheral edge and the inner peripheral edge measured at the major axis is greater than the width of the flexible frame between the outer peripheral edge and the inner peripheral edge measured at the minor axis.

4. A throwing disc as defined by claim 1, wherein the average thickness of the flexible frame between the top side and the bottom side measured at the major axis is greater than the average thickness of the flexible frame between the top side and the bottom side measured at the minor axis.

5. A throwing disc as defined by claim 1, wherein the incremental weight of the flexible frame measured at the major axis is greater than the incremental weight of the flexible frame measured at the minor axis.

6. A throwing disc as defined by claim 1, wherein the central opening defined by the flexible frame is generally oblong in shape.

7. A throwing disc as defined by claim 1, wherein the width of the flexible frame measured along the major axis between diametrically opposite sides of the outer peripheral edge is about 13.25 inches, and wherein the width of the flexible frame measured along the minor axis between diametrically opposite sides of the peripheral edge is about 10.25 inches.

8. A throwing disc as defined by claim 1, wherein the height of the arched shape of the flexible frame not during flight is about 0.41 inches, and wherein the bottom side of the flexible frame is formed with a curvature between diametrically opposite sides of the outer peripheral edge along the major axis having a radius of about 53.3 inches.

9. A throwing disc as defined by claim 1, wherein the flexible frame includes at least first and second openings formed through the thickness thereof, the first and second openings being situated diametrically opposite one another in proximity to the major axis; and wherein the throwing disc further comprises snap-in modules receivable by the at least first and second openings.

10. A throwing disc as defined by claim 9, wherein the snap-in modules include weights.

11. A throwing disc as defined by claim 9, wherein the snap-in modules include radio frequency identification (RFID) tags.

12. A throwing disc as defined by claim 9, wherein the snap-in modules include at least one of light emitting devices and phosphorescent materials.

13. A throwing disc as defined by claim 1, wherein the thickness of the flexible frame between the top side and the bottom side measured near the minor axis is about 0.090 inches, and wherein the thickness of the flexible frame between the top side and the bottom side measured near the major axis is about 0.135 inches.

14. A throwing disc, which comprises:

a non-circular, continuous, flexible frame which changes shape during flight, the flexible frame defining a central opening through the thickness thereof, the flexible frame having a top side, a bottom side opposite the top side, an outer peripheral edge and an inner peripheral edge situated radially inwardly of the outer peripheral edge, the flexible frame having an arched shape both at rest and in flight, with a height that changes during flight, the arched shaped flexible frame defining, a three dimensional cavity situated at the bottom side thereof to provide lift to the throwing disc during flight, wherein the flexible frame includes an outer ring and an inner ring joined to the outer ring and situated radially inwardly of the outer ring.

15. A throwing disc as defined by claim 14, wherein the outer ring is formed from a molded rubber material.

16. A throwing disc as defined by claim 14, wherein the outer ring is formed from a thermoplastic elastomeric material.

17. A throwing disc as defined by claim 16, wherein the central opening is elliptical in shape.

18. A throwing disc as defined by claim 14, wherein the inner ring is formed from polycarbonate.

19. A throwing disc as defined by claim 14, wherein the inner ring is formed from a first material, and the outer ring is formed from a second material, the second material being more flexible than the first material.

20. A throwing disc as defined by claim 14, wherein the flexible frame is formed from injection molded plastic.

21. A throwing disc, which comprises:

a non-circular, continuous, flexible frame which changes shape during flight, the flexible frame defining a central opening through the thickness thereof, the flexible frame having a top side, a bottom side opposite the top side, an outer peripheral edge and an inner peripheral edge situated radially inwardly of the outer peripheral edge, the flexible frame having an arched shape both at rest and in flight, with a height that chances during flieht, the arched shaped flexible frame defining a three dimensional cavity situated at the bottom side thereof to provide lift to the throwing disc during flight, wherein the outer peripheral edge of the flexible frame is sloped inwardly from the bottom side to the top side to divert air flow over the top side of the flexible frame during flight.

22. A throwing disc, which comprises:

a non-circular, continuous, flexible frame which changes shape during flight, the flexible frame defining a central opening through the thickness thereof, the flexible frame having a top side, a bottom side opposite the top side, an outer peripheral edge and an inner peripheral edge situated radially inwardly of the outer peripheral edge, the flexible frame having an arched shape both at rest and in flight, with a height that changes during flight, the arched shaped flexible frame defining a three dimensional cavity situated at the bottom side thereof to provide lift to the throwing disc during flight, wherein at least a portion of the flexible frame has a thickness which increases from the inner peripheral edge toward the outer peripheral edge.

23. A throwing disc as defined by claim 22, wherein the portion of the flexible frame which has a thickness which increases from the inner peripheral edge toward the outer peripheral edge is situated in proximity to the major axis.

* * * * *